US009046864B2

(12) United States Patent
Gondoh et al.

(10) Patent No.: US 9,046,864 B2
(45) Date of Patent: Jun. 2, 2015

(54) CLEANING BLADE, AND IMAGE FORMING APPARATUS USING SAME AND PROCESS CARTRIDGE

(71) Applicants: Masanobu Gondoh, Kanagawa (JP); Yohta Sakon, Kanagawa (JP); Yasuyuki Yamashita, Kanagawa (JP); Shohei Gohda, Kanagawa (JP); Yuka Aoyama, Kanagawa (JP); Shinji Nohsho, Tokyo (JP)

(72) Inventors: Masanobu Gondoh, Kanagawa (JP); Yohta Sakon, Kanagawa (JP); Yasuyuki Yamashita, Kanagawa (JP); Shohei Gohda, Kanagawa (JP); Yuka Aoyama, Kanagawa (JP); Shinji Nohsho, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/134,579

(22) Filed: Dec. 19, 2013

(65) Prior Publication Data

US 2014/0205338 A1 Jul. 24, 2014

(30) Foreign Application Priority Data

Jan. 24, 2013 (JP) ..... 2013-011264

(51) Int. Cl.
*G03G 21/00* (2006.01)

(52) U.S. Cl.
CPC ..... *G03G 21/0017* (2013.01)

(58) Field of Classification Search
CPC ..... G03G 21/0011; G03G 21/0017; G03G 2221/0005
USPC ..... 399/350, 111; 15/256.5, 256.51, 15/256.52; 430/125.1
See application file for complete search history.

(56) References Cited

U.S. PATENT DOCUMENTS

| | | | | |
|---|---|---|---|---|
| 8,369,769 | B2 | 2/2013 | Ohmori et al. | 399/350 |
| 2011/0217102 | A1* | 9/2011 | Ohmori et al. | 399/350 |
| 2013/0243484 | A1* | 9/2013 | Toda et al. | 399/350 |
| 2013/0243507 | A1 | 9/2013 | Sakon et al. | 399/350 |

FOREIGN PATENT DOCUMENTS

| | | | |
|---|---|---|---|
| JP | 2004-233818 | | 8/2004 |
| JP | 3602898 | | 10/2004 |
| JP | 2009-223071 | | 10/2009 |
| JP | 2010-134310 | A * | 6/2010 |
| JP | 2012-177888 | A * | 9/2012 |
| JP | 2013-218277 | | 10/2013 |

* cited by examiner

*Primary Examiner* — Sophia S Chen
(74) *Attorney, Agent, or Firm* — Cooper & Dunham LLP

(57) ABSTRACT

Provided is a cleaning blade formed of an elastic blade and configured to abut on the surface of a cleaning target member, which allows a leading end edge portion of the elastic blade to move on the surface thereof, to remove powder from the surface of the cleaning target member. A blade surface of the elastic blade, which has the leading end edge portion of the elastic blade on one side thereof and faces the surface of the cleaning target member, has a Martens hardness of 1.2 N/mm$^2$ or greater when it is indented by 5 μm at a location that is 20 μm away from the leading end edge portion, a Martens hardness of 1 N/mm$^2$ or less when it is indented by 20 μm at the location, and an elastic power of 70% or greater when it is indented by 5 μm at the location.

14 Claims, 5 Drawing Sheets

CLEANING BLADE, AND IMAGE FORMING APPARATUS USING SAME AND PROCESS CARTRIDGE

BACKGROUND OF THE INVENTION

1. Field of the Invention

The present invention relates to a cleaning blade, and an electrophotographic image forming apparatus using the same and a process cartridge detachably attached to the image forming apparatus.

2. Description of the Related Art

Conventionally, electrophotographic image forming apparatuses have removed unnecessary transfer residue toner deposited on the surface of an image bearing member such as a photoconductor as a cleaning target member, after having transferred a toner image onto a transfer sheet or an intermediate transfer member, with a cleaning device as a cleaning unit. Well-known as a cleaning member of this cleaning device is one with a reed-shaped cleaning blade, because such a cleaning member can be generally configured into a simple structure and has excellent cleaning performance. This cleaning blade is formed of a reed-shaped elastic blade made of a polyurethane rubber or the like. In the cleaning blade, the base end of the elastic blade is supported on a support member, and the leading end edge portion thereof is thrust against the circumferential surface of the image bearing member, in order to remove any residual toner on the image bearing member by banking it up and scraping it off.

To meet the recent demand for images with higher qualities, there is known an image forming apparatus that uses a toner formed by polymerization or the like to have a small particle diameter and nearly a spherical shape (hereinafter referred to as polymerized toner). This polymerized toner is characterized by a high transfer efficiency compared with conventional pulverized toners, and can meet the above demand. However, it is difficult to remove the polymerized toner sufficiently when trying to remove it from the surface of the image bearing member with a cleaning blade, bringing about a problem that a cleaning failure may occur. This failure is because the polymerized toner, which has a small particle diameter and excellent sphericity, can slip through the slight gap formed between the cleaning blade and the image bearing member.

In order to prevent such slip-through, it is necessary to enhance the abutting force of the image bearing member and the cleaning blade against each other to improve the cleaning performance. However, when the abutting force of the cleaning blade is enhanced, the friction force between the cleaning blade 262, the cleaning blade surface 262*b* and the image bearing member 23 increases as shown in FIG. 1A, to thereby drag the cleaning blade 262 to the direction to which the image bearing member 23 is moved, to let the leading end edge portion 262*c* of the cleaning blade ride up. Further, if the cleaning is continued with the leading end edge portion 262*c* of the cleaning blade 262 ridden up, a local wear will occur at a location that is several μm away from the leading end edge portion 262*c* of a leading end surface 262*a* of the cleaning blade 262, as shown in FIG. 1B. If the cleaning is further continued in this state, this local wear will become larger to finally drop off the leading end edge portion 262*c*, as shown in FIG. 1C. If the leading end edge portion 262*c* is dropped off, it is no longer possible to clean away the toner properly, leading to a cleaning failure.

Hence, it has been necessary to make the leading end edge portion of the cleaning blade safer from deformation by enhancing the hardness thereof, in order to suppress the riding up of the leading end edge portion. Japanese Patent (JP-B) No. 3,602,898 describes an elastic blade made of polyurethane elastomer, which is provided, on a region thereof including at least the leading end edge portion thereof, with a surface layer made of a resin having a film hardness that is represented by a pencil hardness of from B to 6 H. With the surface layer having a film hardness represented by a pencil hardness of from B to 6 H that is harder than the elastic blade, it is possible to reduce the friction force between the image bearing member and the cleaning blade, which leads to suppression of the riding up of the leading end edge portion of the cleaning blade. Furthermore, because the surface layer with a pencil hardness of from B to 6 H is hard and less likely to deform, it is possible to suppress the riding up of the leading end edge portion of the cleaning blade with a greater effectiveness.

Japanese Patent Application Laid-Open (JP-A) No. 2004-233818 describes a cleaning blade, which is provided on the surface thereof with a cured layer formed by impregnating an elastic blade with a silicone-containing ultraviolet curable material, swelling the ultraviolet curable material, and thereafter subjecting the blade to ultraviolet irradiation. In this way, also by providing a cured layer made of an ultraviolet curable material harder than the elastic blade, it is possible to suppress the riding up of the leading end edge portion of the cleaning blade.

However, even such cleaning blades as described above provided with a surface layer or a cured layer have caused cleaning failures, under strict conditions such as when performing cleaning after continuous formation of solid images that have resulted in a very large amount of powder having been deposited on the image bearing member. This is considered due to the following reasons. That is, because the surface layer or the cured layer is formed all over the longer direction of the elastic blade, the elasticity of the elastic blade may be inhibited by the surface layer or the cured layer. When the elasticity of the elastic blade is inhibited, the abutting pressure of the cleaning blade abutting on the surface of the image bearing member may vary in the longer direction of the cleaning blade, if the image bearing member is decentered or if the surface of the image bearing member has minute undulations, which leads to degradation of followability of the leading end edge portion of the cleaning blade to the image bearing member. When a large amount of toner is banked up by the cleaning blade such as after solid images are formed continuously, a pressing force of the banked-up toner against the cleaning blade is large. Therefore, in the regions where the abutting pressure of the cleaning blade against the image bearing member is low, the abutting state cannot be maintained in these regions when the pressing force of the toner on the image bearing member against the cleaning blade becomes greater than the abutting force of the cleaning blade, to allow the toner to slip through the cleaning blade. A cleaning failure is considered to have occurred as the result of this, under strict conditions such as when performing cleaning after continuous formation of solid images.

In a cleaning blade provided only with a surface layer such as that described in JP-B No. 3,602,898, if the surface layer is thick, the elasticity of the elastic blade is inhibited by the stiffness of the surface layer, and the followability of the leading end edge portion to the surface of the image bearing member is degraded. Therefore, in the configuration that is provided only with a surface layer, it is necessary to make the surface layer having a high hardness thin in order to maintain the followability of the leading end edge portion to the surface of the image bearing member. When the surface layer is thin, the surface layer will be worn in a short time in the elapse of time of use to the extent to expose the elastic blade. When the elastic blade having a lower hardness is exposed to thereby directly contact the surface of the image bearing member, the coefficient of friction between the cleaning blade and the surface of the image bearing member becomes large, to have the leading end edge portion worn largely.

A cleaning blade as described in JP-A No. 2004-233818, on which a cured layer is formed by impregnating an elastic blade with an ultraviolet curable resin and subjecting it to ultraviolet irradiation, has the following problem. That is, when forming a cured layer in a manner to make the hardness of the outermost surface of the leading end edge portion equal to the hardness obtained when providing a surface layer on the surface of the elastic blade, it is necessary to impregnate the blade with so large an amount of an ultraviolet curable material as enough to cover the surface of the elastic blade. When the blade is impregnated with such a large amount of an ultraviolet curable material, the amount of the ultraviolet curable material soaked into the inside of the elastic blade is also large.

When the elastic blade soaked with a large amount of the ultraviolet curable material is irradiated with ultraviolet, the cured layer will be formed to be excessively hard and to an excessive depth, to thereby inhibit the elasticity of the elastic blade and degrade the followability of the leading end edge portion to the surface of the image bearing member. On the other hand, when the amount of the ultraviolet curable material with which to impregnate the elastic blade is reduced in order to maintain the followability of the leading end edge portion to the surface of the image bearing member, it is impossible to cover the surface of the elastic blade completely with the ultraviolet curable material. The outermost surface of the leading end edge portion will be a mixed state of the rubber material of the elastic blade and the ultraviolet curable material, and the hardness of the outermost surface of the leading end edge portion during an initial time after the start of use will be less than when a surface layer is provided. This will increase the friction force between the cleaning blade and the image bearing member, to make it more likely for the leading end edge portion of the cleaning blade to ride up.

SUMMARY OF THE INVENTION

An object of the present invention is to provide a cleaning blade that can maintain favorable cleaning by suppressing riding up of the leading end edge portion or wear without allowing degradation of the followability to an image bearing member, and an image forming apparatus using the same, and a process cartridge.

As a means for solving the problems described above, a cleaning blade of the present invention is a cleaning blade formed of an elastic blade and configured to abut on the surface of a cleaning target member, which allows a leading end edge portion of the elastic blade to move on the surface thereof, to remove powder from the surface of the cleaning target member.

A blade surface of the elastic blade, which has the leading end edge portion of the elastic blade on one side thereof and faces the surface of the cleaning target member, has a Martens hardness of 1.20 N/mm$^2$ or greater when it is indented by 5 μm at a location that is 20 μm away from the leading end edge portion, has a Martens hardness of 1.00 N/mm$^2$ or less when it is indented by 20 μm at the same location, and has an elastic power of 70% or greater when it is indented by 5 μm at the same location.

As will be seen from the result of a verification experiment to be described later, the present invention suppresses the riding up of the leading end edge portion by imparting a Martens hardness of 1.20 N/mm$^2$ or greater to the blade surface of the elastic blade facing the cleaning target member when the indenting depth is small. Further, by imparting a Martens hardness of 1.00 N/mm$^2$, or less when the indenting depth is large, it is possible to make the whole elastic blade to deform and to secure followability to the image bearing member. Furthermore, by making the elastic power equal to or greater than 70%, it is possible to suppress plastic deformation of the part abutting on the image bearing member, and to improve the wear resistance of the elastic blade. A cleaning blade that satisfies these conditions at the same time can maintain favorable cleaning by suppressing riding up of the leading end edge portion or wear without allowing degradation of the followability to the image bearing member.

DETAILED DESCRIPTION OF THE INVENTION

Figure 2:
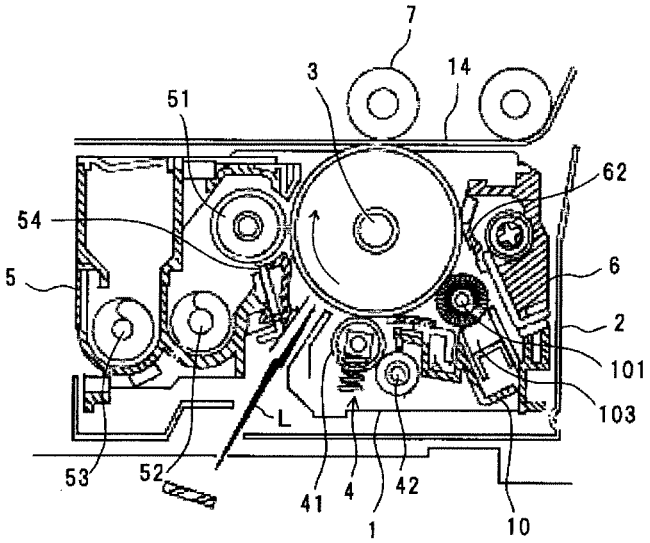
FIG. 2 is a schematic configuration diagram showing an example image forming apparatus (printer) according to an embodiment.

An embodiment in which the present invention is applied to an electrophotographic printer (hereinafter referred to simply as printer), which is an image forming apparatus of the present invention will be explained. FIG. 2 is a schematic configuration diagram showing a principal portion of the printer according to the present embodiment. The printer performs copying in a single color, and performs monochrome image formation based on image data read by an unillustrated image reading unit.

As shown in FIG. 2, the printer includes a drum-shaped photoconductor 3, beneath a transfer belt 14, as an image bearing member. Although the photoconductor 3 is illustrated as having a drum shape, it may have a sheet shape or an endless belt shape.

Around the photoconductor 3, there are provided a charging device 4 as a charging unit, a developing device 5 as a developing unit configured to turn a latent image to a toner image, and a transfer device 7 as a transfer unit configured to transfer the toner image onto a transfer sheet as a recording medium. Around the photoconductor 3, there are also provided a cleaning device 6 as a cleaning unit configured to remove residual toner on the photoconductor 3 after having transferred the image, a lubricant coating device 10 configured to coat the photoconductor 3 with a lubricant, an unillustrated charge eliminating lamp configured to diselectrify the photoconductor 3, etc. The lubricant coating device 10 needs not be provided.

The charging device 4 is provided contactlessly from the photoconductor 3 with a predetermined distance therefrom, and includes a charging roller 41 configured to electrically charge the photoconductor 3 to a predetermined polarity and to a predetermined potential, and a charge cleaning roller 42 configured to remove toner deposited on the charging roller 41. The photoconductor 3 uniformly charged by the charging device 4 is irradiated with light L based on image data by an unillustrated exposing device as a latent image forming unit, to have an electrostatic latent image formed thereon. As the charging device 4, a publicly known means such as a corotron, a scorotron, and a solid state charger is used. Among these charging systems, particularly, a contact type charging system and a contactless system to be provided in proximity are more preferable, because of advantages such as a high charging efficiency, a small amount of ozone to be generated, device downsizeability, etc.

The developing device 5 includes a developing roller 51 as a developer bearing member. A developing bias is applied to the developing roller 51 from an unillustrated power source. Within the casing of the developing device 5, there are provided a supplying screw 52 and a stirring screw 53, which are configured to convey the developer contained in the casing to opposite directions from each other to thereby stir the developer. There is also provided a doctor 54 configured to regulate the developer borne on the developing roller 51. Toner being developed, which is stirred and conveyed by the two screws, namely the supplying screw 52 and the stirring screw 53, is charged to a predetermined polarity. Then, the developer is drawn up into the developing roller 51. The drawn-up developer is regulated by the doctor 54, and the toner is deposited on the latent image on the photoconductor 3 in the developing region facing the photoconductor 3.

The cleaning device 6 includes a cleaning blade 62, etc. The cleaning blade 62 abuts on the photoconductor 3, by facing a direction counter to the direction of the surface motion of the photoconductor 3. The details of the cleaning blade 62 will be described later.

The lubricant coating device 10 includes a solid lubricant 103, a lubricant pressurizing spring (unillustrated), etc., and uses a fur brush 101 as a coating brush for coating the solid lubricant 103 onto the photoconductor 3. The solid lubricant 103 is borne within an unillustrated bracket, and pressurized toward the fur brush 101 by the lubricant pressurizing spring (unillustrated). The solid lubricant 103 is scraped off and coated onto the photoconductor 3 by the fur brush 101 that is rotating in the direction to follow the direction of rotation of the photoconductor 3.

As the light source of the unillustrated exposing device and the charge eliminating lamp, emission materials of all kinds including a fluorescent lamp, a tungsten lamp, a halogen lamp, a mercury lamp, a sodium vapor lamp, a light emitting diode (LED), a laser diode (LD, and electroluminescence (EL) can be used. Further, in order to apply light of only a desired wavelength range, various kinds of filters such as a sharp cut filter, a band pass filter, a near infrared cut filter, a dichroic filter, an interference filter, and a color temperature conversion filter may be used. Among these light sources, a light emitting diode and a laser diode are preferably used, because they have a high irradiation energy and emit light of a long wavelength of from 600 nm to 800 nm.

An image forming operation of the printer having the above configuration will be explained. Upon a signal to execute printing from an unillustrated operation unit or the like, a predetermined voltage or current is applied to the charging device 4 and the developing roller 51 sequentially at predetermined timings. Likewise, a predetermined voltage or current is also applied to the exposing device, the charge eliminating lamp, etc. sequentially at predetermined timings. Synchronously with this, the photoconductor 3 is started to rotate in the direction of the arrow of FIG. 2 by a photoconductor driving motor (unillustrated) as a driving unit.

Upon rotation of the photoconductor 3 in the direction of the arrow of FIG. 2, the surface of the photoconductor 3 is charged to a predetermined potential by the charging device 4. Then, the photoconductor 3 is irradiated by the unillustrated exposing device with light L corresponding to an image signal, and the portions of the photoconductor 3 that are irradiated with the light L are diselectrified to thereby form an electrostatic latent image.

The photoconductor 3, on which the electrostatic latent image is formed, has its surface slid over and frictioned by a magnetic brush of the developer formed on the developing roller 51 in a region facing the developing device 5. At this time, negatively charged toner on the developing roller 51 is migrated toward the electrostatic latent image under a predetermined developing bias applied to the developing roller 51, to be turned to a toner image (developed). In this way, in the present embodiment, the electrostatic latent image formed on the photoconductor 3 is reversely developed with the negatively charged toner by the developing device 5. In the present embodiment, an example in which a contactless charging roller system of an N/P type (negative-positive type in which toner is deposited onto lower potential portions) is employed has been explained. However, the present invention is not limited to this.

The toner image formed on the photoconductor 3 is transferred onto a transfer sheet as a recording medium, which is fed to a transfer region formed between the photoconductor 3 and the transfer device 7, from an unillustrated sheet feeding unit via a portion where an upper registration roller and a lower registration roller face with each other. At this time, the transfer sheet is fed by being made synchronous with the leading end of the image at the portion where the upper registration roller and the lower registration roller face with each other. Further, for the image to be transferred to the transfer sheet, a predetermined transfer bias is applied. The transfer sheet on which the toner image is transferred is detached from the photoconductor 3, and conveyed to an unillustrated fixing device. Then, by passing through the fixing device, the toner image is fixed on the transfer sheet with the effect of heat and pressure, and the transfer sheet is discharged from the apparatus.

Meanwhile, the surface of the photoconductor 3 after having transferred the image has any toner remained after the transfer removed by the cleaning device 6, coated with the lubricant by the lubricant coating device 10, and then diselectrified by the charge eliminating lamp.

In the present printer, the photoconductor 3, and the charging device 4, the developing device 5, the cleaning device 6, the lubricant coating device 10, and the like, which are a process unit, are housed within a frame member 2, and are configured integrally detachable from the apparatus body as a process cartridge 1. In the present embodiment, the photoconductor 3 and the process unit are configured integrally replaceable as the process cartridge 1. However, it is also possible that they be configured replaceable with new ones in a unit including the photoconductor 3, the charging device 4, the developing device 5, the cleaning device 6, and the lubricant coating device 10.

Figure 3:
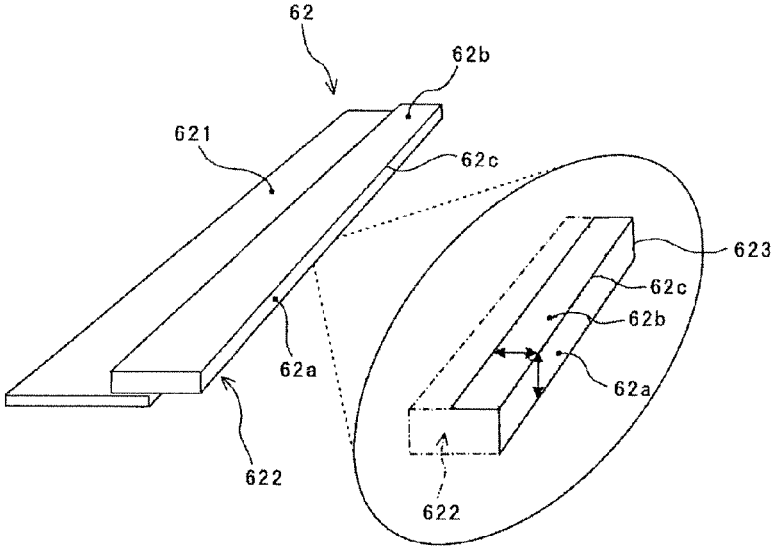
FIG. 3 is a perspective diagram showing an example cleaning blade of a cleaning device of the printer of FIG. 2.
Figure 4:
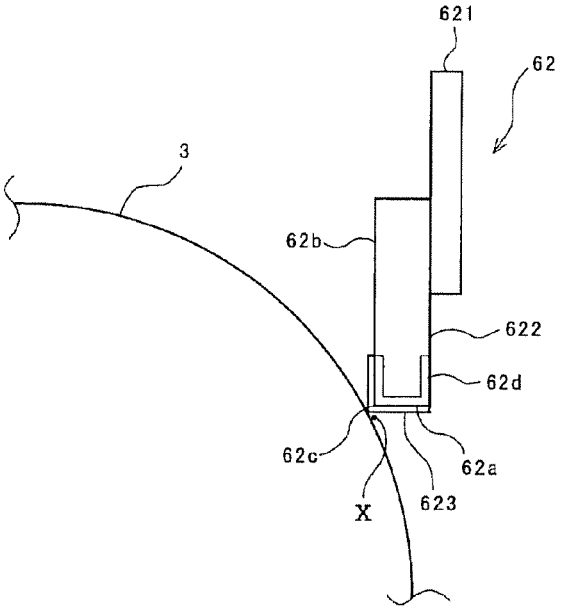
FIG. 4 is a configuration diagram showing an example configuration of a cleaning blade.
Figure 5:
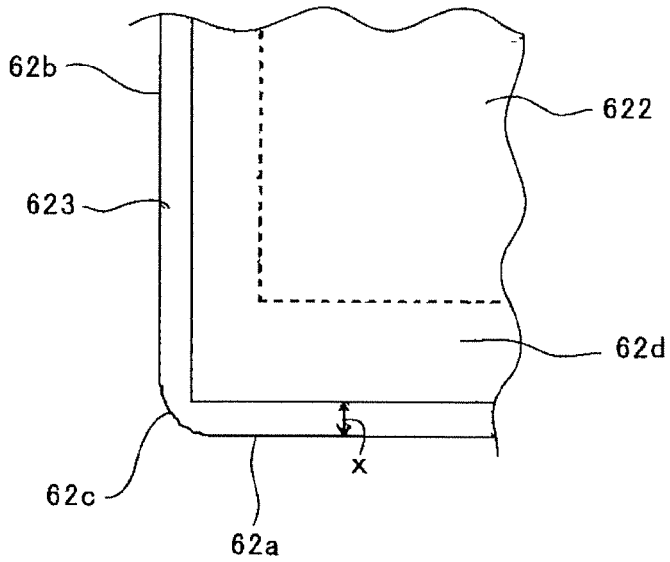
FIG. 5 is a partially expanded configuration diagram showing an example configuration of a leading end surface and a bottom surface of a cleaning blade.

Next, the cleaning blade, which is the feature of the present invention, will be explained. FIG. 3 is a perspective diagram showing the configuration of the cleaning blade. FIG. 4 is a configuration diagram showing the configuration of this cleaning blade. FIG. 5 is a partially expanded configuration diagram showing the configuration of the cleaning blade. As shown in FIG. 3 and FIG. 4, the cleaning blade 62 is constituted by a holder 621 made of a stiff material such as metal and hard plastic, and an elastic blade 622. The elastic blade 622 is secured with an adhesive or the like to one end of the holder 621, and the other end of the holder 621 is cantilevered on the case of the cleaning device 6. In the following description, a surface of the cleaning blade 62 that has on one side thereof a leading end edge portion 62*c* to abut on the photoconductor 3 and that is parallel with the direction of the thickness of the elastic blade 622 will be referred to as a blade leading end surface 62*a*, and a surface that has on one side thereof the leading end edge portion 62*c* and that faces the photoconductor 3 will be referred to as a blade surface 62*b*.

The present inventors have conducted earnest studies about the riding up of the leading end edge portion 62*c* of the cleaning blade 62 and discovered that the riding up of the leading end edge portion 62*c* is largely influenced by the hardness of a portion of the blade surface 62*b* that is up to several ten μm from the leading end edge portion 62*c*. It has also been discovered that when the portion of the blade surface 62*b* that is up to several ten μm from the leading end edge portion 62*c* abuts on the photoconductor 3 to be thereby slid over and frictioned with the photoconductor 3, a surface layer 623 to be described later slightly deforms, and this plastic deformation causes wear.

Hence, in the cleaning blade 62 of the present embodiment, a hardness is specified for the portion about the leading end edge portion 62*c*. Martens hardness described in ISO14577-1 is used as the index of the hardness. A Martens hardness is a value obtained from a test load vs. indented depth curve. Because a test depth, when set to a very small value, corresponds to an amount by which the leading end edge portion 62*c* deforms due to the friction force between the cleaning blade 62 and the photoconductor 3, it is possible to evaluate the degree of riding up of the leading end edge portion 62*c*. Here, it is important to measure from a location close to the leading end edge portion 62*c*. When the test depth is set to a large value, the amount of deformation of the whole elastic blade 622 will be evaluated, which enables evaluation of the followability to the photoconductor 3.

Hence, in the cleaning blade 62 according to the present embodiment, the Martens hardness of the blade surface 62*b* when it is indented by 5 μm with a quadrangular pyramid Vickers indenter at a location that is 20 μm away from the leading end edge portion 62*c* is 1.2 $N/mm^2$ or greater. Further, the Martens hardness when the blade surface is indented by 20 μm with the quadrangular pyramid Vickers indenter at the same location is 1 $N/mm^2$ or less. By measuring the Martens hardness of the blade surface 62*b* when it is indented by 5 μm at a location that is 20 μm away from the leading end edge portion 62*c*, it is possible to know the hardness about the leading end edge portion 62*c*. When the Martens hardness is equal to or greater than a certain value, a large stress occurs in the leading end edge portion 62*c* under a deforming force due to the friction force between the elastic blade 622 and the photoconductor 3, which makes it possible to suppress the riding up of the leading end edge portion 62*c*. Further, a value of Martens hardness that is measured when the blade surface is indented by 20 μm at the same location can be said to represent a physical property of the blade that is more macro-scaled than the value measured when the blade surface is indented by 5 μm. Therefore, when the Martens hardness is equal to or less than a certain value, the whole elastic blade 622 can largely deform, with no degradation of the followability to the surface of the photoconductor 3.

Elastic power, which is defined as ηIT described in ISO14577-1 is an index indicating an amount of plastic deformation of the part of the elastic blade 622 that abuts on the photoconductor 3. Elastic power is a value representing a relationship between elastic work and plastic work, and indicates how susceptible to plastic deformation a material is. When the part of the elastic blade 622 that abuts on the photoconductor 3 is susceptible to plastic deformation, a large wear will occur. Here, it is important to perform the measurement from the part of the elastic blade 622 that abuts on the photoconductor 3.

Hence, in the cleaning blade 62 according to the present embodiment, the elastic power of the blade surface 62*b* when it is indented by 5 μm with a quadrangular pyramid Vickers indenter at a location that is 20 μm away from the leading end edge portion 62*c* is 70% or greater. By making the elastic power when the blade surface is indented by 5 μm at this location equal to or greater than a certain value, it is possible to suppress plastic deformation of the part abutting on the photoconductor 3, and to improve the wear resistance of the elastic blade 622.

Further, in the cleaning blade 62 according to the present embodiment, it is more preferable that the elastic power of the blade bottom portion 62*b* when it is indented by 20 μm with a quadrangular pyramid Vickers indenter at a location that is 20 μm away from the leading end edge portion 62*c* be 90% or less. The value of elastic power that is measured when the blade surface is indented by 20 μm at this location can be said to represent a physical property of the blade that is more macro-scaled than the value measured when the blade surface is indented by 5 μm at the same location. Therefore, when the elastic power is equal to or less than a certain value, the whole elastic blade 622 can largely deform, with no degradation of the followability to the surface of the photoconductor 3.

In order to satisfy the characteristics described above, the cleaning blade 62 according to the present embodiment is preferably configured as follows. As shown in FIG. 3 and FIG. 4, the cleaning blade 62 is constituted by the elastic blade 622, and a surface layer 623 that covers such surfaces of the elastic blade 622 as including the leading end edge portion 62*c* and that is harder than the elastic blade 622. The surface layer 623 is formed all over the longer direction of the elastic blade 622 on the blade leading end surface 62*a* and the blade surface 62*b*, both of which include the leading end edge portion 62*c*.

The elastic blade 622 is preferably made of a material having a high repulsive elastic modulus such as a urethane rubber, which is a rubber containing a urethane group, in order to be able to follow decentering of the photoconductor 3 or minute undulations on the surface of the photoconductor 3. Particularly, a urethane rubber having a hardness of from 66 to 80 degrees (JIS A) at 25° C. is preferable. When the hardness of a urethane rubber is greater than 80 degrees, the flexibility thereof is poor. Therefore, for example, when the holder 621 is set minutely lopsidedly, the cleaning blade 62 tends to have a non-uniform contact to have abutting pressures that vary from its longer-direction one end to the other end, making it impossible to obtain an abutting pressure that is uniform over the longer direction. As a result, the cleaning performance might degrade. On the other hand, when the hardness of the urethane rubber is less than 66 degrees, the cleaning blade 62 might warp to have the leading end edge portion 62*c* of the cleaning blade 62 float up. Therefore, the cleaning blade 62 has its blade surface 62*b* abut on the photoconductor 3 to have a so-called contact at the trunk portion. When a contact at the trunk portion occurs, the area over which the cleaning blade 2 and the surface of the photoconductor 3 abut on each other increases drastically. Therefore, when the cleaning blade 62 is thrust with a large force, the abutting pressure will decrease counter to the intent, which will degrade the cleaning performance. As will be described later, these phenomena occur conspicuously in the configuration including the surface layer 623 that is formed to cover the leading end edge portion 62*c*. Therefore, the hardness needs to be in the range described above.

The elastic blade 622 may be a double-layered type that is formed by laminating two kinds of different materials. Also in this case, it is preferable that the hardness of the urethane rubber be in the range described above. However, it is possible to appropriately select suitable materials for the abutting side and for the side opposite to the abutting side.

The surface layer 623 is formed by spray coating, dip coating, screen printing, etc. so as to cover the leading end edge portion 62*c* of the cleaning blade 62. By being made of a material harder than the elastic blade 622, the surface layer 623 is stiff, hardly deforms, and can suppress riding up of the leading end edge portion 62*c* of the cleaning blade 62.

The surface layer 623 is made of preferably a resin, more preferably an ultraviolet curable resin. Use of an ultraviolet curable resin makes it possible to obtain a surface layer 623 having a desired hardness only by irradiating the resin coated on the leading end edge portion 62*c* of the cleaning blade 62 with ultraviolet, and to manufacture the cleaning blade 62 at low costs.

The ultraviolet curable resin used for the surface layer 623 is preferably an ultraviolet curable resin that contains at least a fluorine-based acrylic monomer. A preferable fluorine-based acrylic monomer is an acrylate having a perfluoropolyether skeleton and 2 or more functional groups. By containing a fluorine group, a fluorine-based acrylic monomer, particularly, an acrylate having a perfluoropolyether skeleton and 2 or more functional groups can improve the slidability of the cleaning blade 62 and prevent riding up. Further, by having 2 or more functional groups, they can cross-link with other acrylic monomers and form a cross-linked film.

Figure 1A:
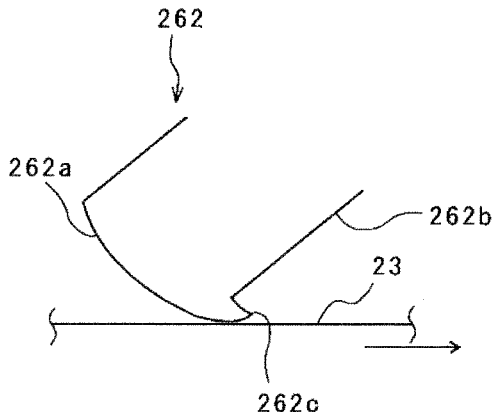
FIG. 1A is an exemplary diagram showing a state in which the leading end ride portion of a cleaning blade is riding up.
Figure 1B:
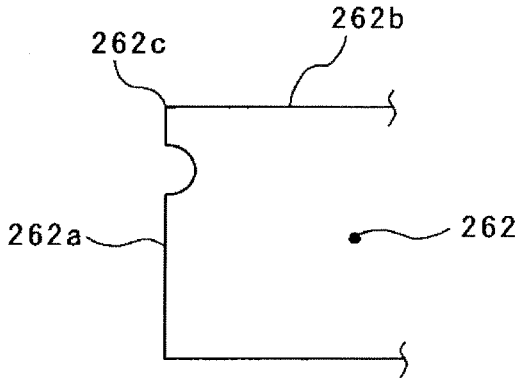
FIG. 1B is an exemplary diagram explaining a local wear on a leading end surface of the cleaning blade.
Figure 1C:
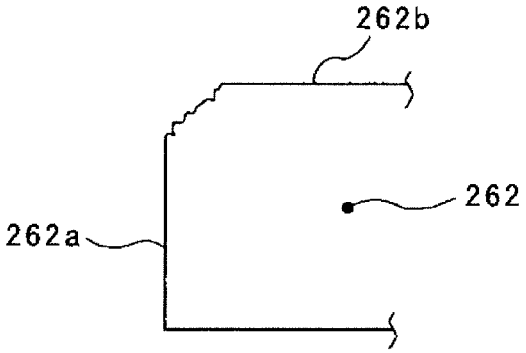
FIG. 1C is an exemplary diagram showing a state in which the leading end edge portion of the cleaning blade is dropped off.

As the ultraviolet curable resin used for the surface layer 623, an acrylate having a functional group equivalent molecular weight of 350 or less, 3 to 6 functional groups, and pentaerythritol triacrylate as a main skeleton is preferably used in combination with the fluorine-based acrylic monomer. When the functional group equivalent molecular weight is greater than 350 or when a material other than a pentaerythritol triacrylate skeleton is used, the surface layer 623 might become too weak. When the surface layer 623 is weak, the leading end edge portion 62*c* of the cleaning blade 62 may ride up to cause a wear in the blade leading end surface 62*a* as shown in FIG. 1B, which makes it impossible to maintain the cleaning ability for a long time. Further, as the ultraviolet curable resin used for the surface layer 623, it is preferable, where appropriate, to mix an acrylate having a functional group equivalent molecular weight of from 100 to 1,000 and 1 or 2 functional groups, in addition to the pentaerythritol triacrylate skeleton material. This can impart flexibility to the surface layer 623.

Here, a functional group equivalent molecular weight means a molecular weight per functional group.

The layer thickness of the surface layer 623 is preferably from 0.2 μm to 1 μm. When the layer thickness is less than 0.2 μm, the stiffness of the surface layer 623 is weakened to make it likely for the leading end edge portion 62*c* of the cleaning blade 62 to ride up. When the layer thickness is greater than 1 μm, plastic deformation of the surface layer 623 becomes large to increase the amount of wear.

Further, in the cleaning blade 62 according to the present embodiment, it is preferable to form an ultraviolet curable resin including portion 62*d*, which includes an ultraviolet curable resin, in a region of the elastic blade 622 that includes the leading end edge portion 62*c*. The ultraviolet curable resin including portion 62*d* can be formed by impregnating the elastic blade 622 with an ultraviolet curable resin from the surface of the elastic blade 622.

In the elastic blade 622, with impregnation of an ultraviolet curable resin in the ultraviolet curable resin including portion 62*d* including the leading end edge portion 62*c*, improvement of the hardness of the leading end edge portion 62*c* is sought so as to suppress the leading end edge portion 62*c* from deforming to the direction to which the photoconductor 3 is moved. Further, even when the elastic blade 622 is exposed due to aging wear of the surface layer 623, such a deformation can likewise be suppressed with impregnation of an ultraviolet curable resin in the ultraviolet curable resin including portion 62*d*.

As a treatment for impregnating the elastic blade 622 with an ultraviolet curable resin, brush coating, spray coating, and dip coating are preferable. It is preferable to start the impregnation treatment from the leading end surface of the elastic blade by a width approximately the same as the thickness of the elastic blade. When the width of impregnation into the elastic blade 622 is large, the elasticity of the blade will be spoiled to be unable to follow up the photoconductor 3 as the image bearing member. When the width of impregnation into the elastic blade 622 is small, the leading end edge portion 62*c* might ride up.

The reason why the reforming effect of improving the hardness of the leading end edge portion 62*c* can be obtained by forming the ultraviolet curable resin including portion 62*d* including an ultraviolet curable resin in the elastic blade 622 is considered as follows. Because a network chain of the ultraviolet curable resin will be formed in the elastic rubber, which is the base material of the elastic blade 622, the crosslink density of the elastic rubber itself will be seemingly increased, which is considered to have the reforming effect of improving the wear resistance. What is important here is that the ultraviolet curable resin and the urethane rubber may barely be chemically bonded with each other. Generally, when enhancing urethane rubber by impregnation, isocyanate is often used as the material with which to impregnate the rubber. Because isocyanate is chemically reactive with urethane rubber, the crosslink density will become too high. As a result, the rubber will be no longer like a rubber but a glass, which will suppress the movement of the edge too much and deteriorate the wear resistance counter to the intent.

As another reforming effect, the ultraviolet curable resin in the ultraviolet curable resin including portion 62*d* of the elastic blade 622 seems to exert a so-called "anchor effect" with respect to the ultraviolet curable resin in the surface layer 623, etc. This effect is considered to increase the close adhesiveness between the elastic blade 622 and the surface layer 623 to thereby increase the durability of the cleaning blade 62.

The ultraviolet curable resin used for the impregnation is preferably an acrylic monomer having a functional group equivalent molecular weight of 350 or less, 3 to 6 functional groups, and pentaerythritol triacrylate as a main skeleton, like in the surface layer 623. Further, where appropriate, it is preferable to mix an acrylate having a functional group equivalent molecular weight of from 100 to 1,000 and 1 to 2 functional groups, in addition to the pentaerythritol triacrylate skeleton material. When the functional group equivalent molecular weight is greater than 350 or when a material other than a pentaerythritol triacrylate skeleton is used, the ultraviolet curable resin so including portion 62*d* might be too weak. When the ultraviolet curable resin including portion 62*d* is weak, the leading end edge portion 62*c* of the cleaning blade 62 may ride up to cause a wear in the blade leading end surface 62*a* as shown in FIG. 1B, which makes it impossible to maintain the cleaning ability for a long time. Further, as the ultraviolet curable resin used for the impregnation, it is preferable, where appropriate, to mix an acrylate having a functional group equivalent molecular weight of from 100 to 1,000 and 1 or 2 functional groups, in addition to the pentaerythritol triacrylate skeleton material. This will impart flexibility to the ultraviolet curable resin including portion 62*d*.

EXAMPLES

Examples 1 to 14 and Comparative Examples 1 to 5

Next, a verification experiment conducted by the present inventors will be explained. This verification experiment was conducted for cleaning blades of Examples 1 to 14 and Comparative Examples 1 to 5, which were manufactured by varying the material of the elastic blade 622, the material used for the impregnation, and the material of the surface layer 623 as shown in Table 1-1.

[Elastic Blade]

Three kinds of urethane rubbers having the following physical properties at 25° C. were prepared as the elastic blade 622.

Urethane rubber 1: hardness of 68 degrees, repulsive elastic modulus of 30% (manufactured by Toyo Tire & Rubber Co., Ltd.)

Urethane rubber 2: double-layered, abutting side hardness of 80 degrees, opposite side hardness of 75 degree, repulsive elastic modulus of 25% (manufactured by Toyo Tire & Rubber Co., Ltd.)

Urethane rubber 3: double-layered, abutting side hardness of 85 degrees, opposite side hardness of 75 degrees, repulsive elastic modulus of 25% (manufactured by Toyo Tire & Rubber Co., Ltd.)

The hardness of the urethane rubbers was measured with a micro rubber hardness tester MD-1 manufactured by Kobunshi Keiki Co., Ltd. according to JIS K6253. The urethane rubber 2 (double-layered) was measured from both sides.

The repulsive elasticity of the urethane rubbers was measured with a resilience tester No. 221 manufactured by Toyo Seiki Seisaku-Sho, Ltd. according to JIS K6255. The sample was a laminate of sheets of about 2 mm so as to be 4 mm or greater thick.

The following curable materials 1 to 5 were used as the curable materials used for impregnation of the ultraviolet curable resin including portion 62*d* and formation of the surface layer 623.

[Curable Material 1]

Ultraviolet curable resin 1: pentaerythritol triacrylate (8 parts by mass) (with 3 functional groups and a functional group equivalent molecular weight of 99) (PETIA manufactured by Daicel-Cytec Company, Ltd.)

Ultraviolet curable resin 2: octyl/decyl acrylate (2 parts by mass) (with 1 functional group and a functional group equivalent molecular weight of 226) (ODA-N manufactured by Daicel-Cytec Company, Ltd.)

Ultraviolet curable resin 3: fluorine-based acrylate (0.1 parts by mass) (OPTOOL DAC-HP manufactured by Daikin Industries, Ltd.)

Polymerization initiator: 1.2α hydroxy alkyl phenone (0.5 parts by mass) (Irgacure 184 manufactured by Ciba Specialty Chemicals Inc.)

Solvent: cyclohexanone (89.4 parts by mass)

[Curable Material 2]

Ultraviolet curable resin 1: pentaerythritol triacrylate (10 parts by mass) (with 3 functional groups and a functional group equivalent molecular weight of 99) (PETIA manufactured by Daicel-Cytec Company, Ltd.)

Ultraviolet curable resin 3: fluorine-based acrylate (0.1 parts by mass) (OPTOOL DAC-HP manufactured by Daikin Industries, Ltd.)

Polymerization initiator: 1.2α hydroxy alkyl phenone (0.5 parts by mass) (Irgacure 184 manufactured by Ciba Specialty Chemicals Inc.)

Solvent: cyclohexanone (89.4 parts by mass)

[Curable Material 3]

Ultraviolet curable resin 4: dipentaerythritol triacrylate (8 parts by mass) (with 6 functional groups and a functional group equivalent molecular weight of 96) (DPHA manufactured by Daicel-Cytec Company, Ltd.)

Ultraviolet curable resin 2: octyl/decyl acrylate (2 parts by mass) (with 1 functional group and a functional group equivalent molecular weight of 226) (ODA-N manufactured by Daicel-Cytec Company, Ltd.)

Ultraviolet curable resin 3: fluorine-based acrylate (0.1 parts by mass) (OPTOOL DAC-HP manufactured by Daikin Industries, Ltd.)

Polymerization initiator: 1.2α hydroxy alkyl phenone (0.5 parts by mass) (Irgacure 184 manufactured by Ciba Specialty Chemicals Inc.)

Solvent: cyclohexanone (89.4 parts by mass)

[Curable Material 4]

Ultraviolet curable resin 4: dipentaerythritol triacrylate (10 parts by mass) (with 6 functional groups and a functional group equivalent molecular weight of 96) (DPHA manufactured by Daicel-Cytec Company, Ltd.)

Ultraviolet curable resin 3: fluorine-based acrylate (0.1 parts by mass) (OPTOOL DAC-HP manufactured by Daikin Industries, Ltd.)

Polymerization initiator: 1.2α hydroxy alkyl phenone (1 part by mass) (Irgacure 184 manufactured by Ciba Specialty Chemicals Inc.)

Solvent: cyclohexanone (89 parts by mass)

[Curable Material 5]

Ultraviolet curable resin 1: pentaerythritol triacrylate (8 parts by mass) (with 3 functional groups and a functional group equivalent molecular weight of 99) (PETIA manufactured by Daicel-Cytec Company, Ltd.)

Ultraviolet curable resin 2: octyl/decyl acrylate (2 parts by mass) (with 1 functional group and a functional group equivalent molecular weight of 226) (ODA-N manufactured by Daicel-Cytec Company, Ltd.)

Polymerization initiator: 1.2α hydroxy alkyl phenone (0.5 parts by mass) (Irgacure 184 manufactured by Ciba Specialty Chemicals Inc.)

Solvent: cyclohexanone (89.5 parts by mass)

Ultraviolet curable resin 1: the structure of pentaerythritol triacrylate (PETIA manufactured by Daicel-Cytec Company, Ltd.) is expressed by the following structural formula.

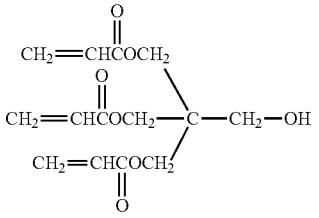

Ultraviolet curable resin 4: the structure of dipentaerythritol triacrylate (DPHA manufactured by Daicel-Cytec Company, Ltd.) is expressed by the following structural formula.

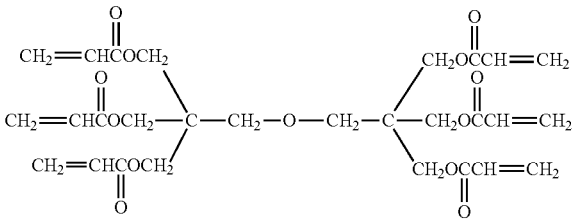

Next, the configuration of the image forming apparatus with which the verification experiment was conducted will be explained.

An elastic blade having a thickness of 1.8 mm was manufactured with either the urethane rubber 1 or 2. The leading end portion of the blade was immersed in each of the curable resins described above from the leading end to a depth approximately equal to the thickness of 1.8 mm for a predetermined time to be impregnated therewith, and after this, air-dried for 3 minutes. Then, a surface layer was formed of each of the curable materials by spray coating. In the formation of the surface layer, specifically, spray coating was applied from the blade leading end surface at a spray gun moving speed of 10 mm/s to overlay coatings on the leading end surface so as to be a predetermined thickness. After set-to-touch drying was performed for 3 minutes, coating was also applied to the blade surface in the same manner so as to form a surface layer thereon. After this, set-to-touch drying was performed for another 3 minutes, and then exposure to ultraviolet was performed (140 [W/cm]×5 [m/min]×5 passes). At this time, the region on which the surface layer was to be formed by spray coating was restricted within a masking tape.

The layer thickness (indicated by x in FIG. 5) of the surface layer was measured with a microscope VHX-100 manufactured by Keyence Corporation, from a cross-section of another elastic blade that was coated in the same manner. The sample cross-section was cut out with a trimming razor for SEM sample manufacture manufactured by Nisshin EM Corporation.

Martens hardness and elastic power of the blade surface were measured with a microhardness tester FISCHERSCOPE HM2000 manufactured by Fischer. These were obtained as values that were measured when the surface of the blade surface of each blade was indented by 5 μm or 20 μm. The indenting conditions were an indenting depth of 5 μm or 20 μm, an indenting load of 2 mN, an indenting time of 20 s, and a creep time of 5 s.

Next, each of the elastic blades manufactured in Examples 1 to 14 and Comparative Examples 1 to 5 was secured with an adhesive to a plate holder that was mountable on a color multifunction printer IMAGIO MP C5001 manufactured by Ricoh Company Ltd., to be used as a prototype cleaning blade. Each prototype cleaning blade was mounted on a color multifunction printer IMAGIO MP C5001 (having the same configuration as shown in FIG. 2) manufactured by Ricoh Company Ltd. to manufacture image forming apparatuses of Examples 1 to 14 and Comparative Examples 1 to 5. When mounting the cleaning blade, a linear pressure and a cleaning angle were set based on a predetermined edge biting amount and a predetermined mounting angle. The lubricant coating device was removed.

In the verification experiment, a toner manufactured by polymerization was used. The physical properties of the toner were as follows.

Toner base: Circularity of 0.98, average particle diameter of 4.9 μm

External additives: small-diameter silica (1.5 parts by mass) (H2000 manufactured by Clariant International Ltd.)

small-diameter titanium oxide (0.5 parts by mass) (MT-150AI manufactured by Tayca Corporation)

large-diameter silica (1.0 part by mass) (UFP-30H manufactured by Denki Kagaku Kogyo Kabushiki Kaisha)

The verification experiment was conducted under a laboratory atmosphere of 21° C. and 65% RH, on a sheet passing condition of 3 prints of a 5% image occupation rate chart per job on 2,500 sheets (A4 size, in the horizontally-long direction). Then, the following points were evaluated.

[Evaluation Points]

Occurrence of cleaning failure: presence or absence (by visual observation)

Image evaluated: a pattern of longitudinal bars (in the direction in which the sheet was conveyed) having a width of 43 mm, with 3 charts, output on 20 sheets (A4 size, in the horizontally-long direction)

Figure 6:
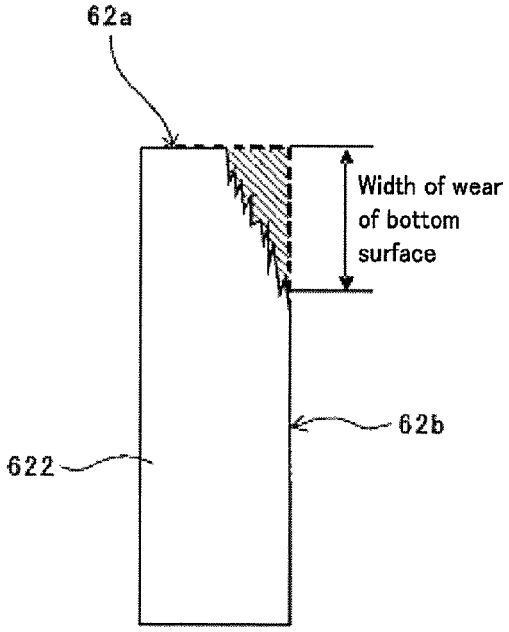
FIG. 6 is an exemplary diagram showing a portion of an elastic blade from which an amount of wear is measured.

Amount of wear of the blade (μm): the width of wear of the blade surface shown in FIG. 6 was evaluated.

Amount of riding up of the blade (μm): a glass plate was coated with a surface layer of the photoconductor in order to visualize, from the back of the glass plate, the blade abutting state of the cleaning blade when it was slid over and frictioned with the coated surface layer on the same conditions as the conditions described above, and to evaluate the length by which the leading end edge portion rode up.

Figure 7:
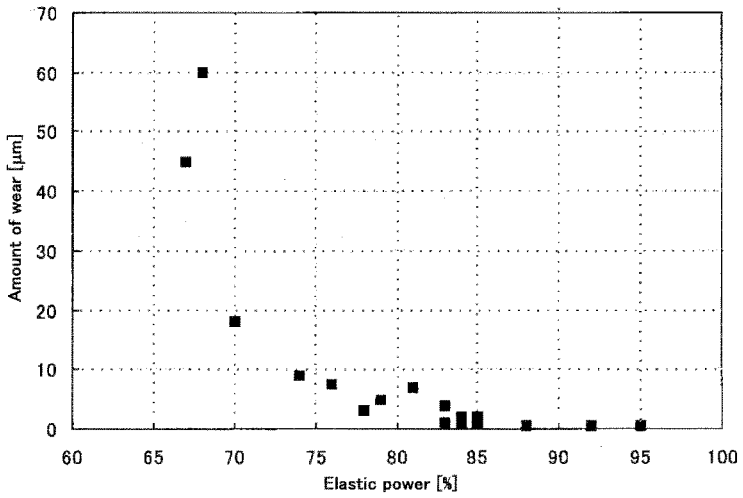
FIG. 7 is a characteristic diagram showing a relationship between an amount of wear and elastic power of an elastic blade.
Figure 8:
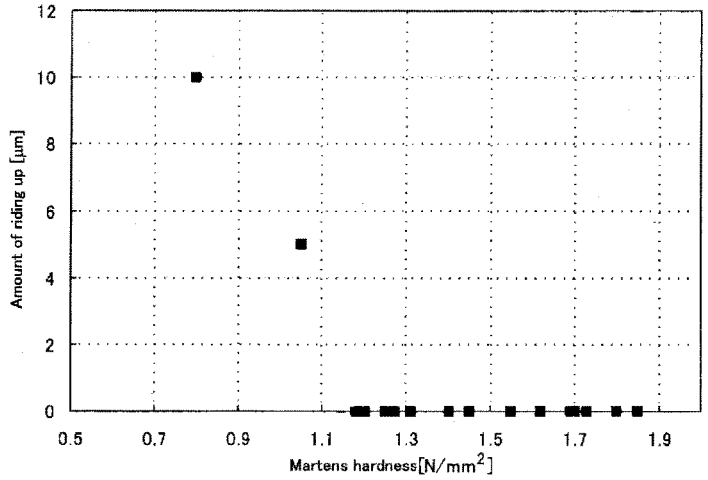
FIG. 8 is a characteristic diagram showing a relationship between an amount of riding up and elastic power of an elastic blade.

The results of the verification experiment on Examples and Comparative Examples are shown in Table 1-2, and FIG. 7 and FIG. 8.

TABLE 1-1

| | Base urethane | Curable material of surface layer | Surface layer thickness [μm] | Impregnation | Curable material for impregnation | Impregnation time |
|---|---|---|---|---|---|---|
| Ex. 1 | 2 | 1 | 0.5 | Not done | — | — |
| Ex. 2 | 2 | 1 | 1 | Not done | — | — |
| Ex. 3 | 2 | 2 | 0.6 | Not done | — | — |
| Ex. 4 | 2 | 2 | 1 | Not done | — | — |
| Ex. 5 | 2 | 3 | 0.5 | Not done | — | — |
| Ex. 6 | 2 | 3 | 1 | Not done | — | — |
| Ex. 7 | 2 | 4 | 0.5 | Not done | — | — |
| Ex. 8 | 2 | 4 | 1 | Not done | — | — |
| Ex. 9 | 2 | 1 | 1 | Done | 5 | 10 s |
| Ex. 10 | 2 | 1 | 0.5 | Done | 1 | 10 s |
| Ex. 11 | 2 | 1 | 0.5 | Done | 1 | 30 s |
| Ex. 12 | 2 | 1 | 1 | Done | 1 | 10 s |
| Ex. 13 | 2 | 1 | 1 | Done | 1 | 30 s |
| Ex. 14 | 1 | 1 | 1 | Done | 1 | 30 s |

TABLE 1-1-continued

| | Base urethane | Curable material of surface layer | Surface layer thickness [μm] | Impregnation | Curable material for impregnation | Impregnation time |
|---|---|---|---|---|---|---|
| Comp. Ex. 1 | 1 | — | — | Not done | — | — |
| Comp. Ex. 2 | 2 | — | — | Not done | — | — |
| Comp. Ex. 3 | 2 | 2 | 3 | Done | 1 | 30 s |
| Comp. Ex. 4 | 2 | 2 | 1 | Done | 1 | 30 s |
| Comp. Ex. 5 | 3 | — | 0.5 | Not done | — | — |

blade to move on the surface thereof to remove powder from the surface of the cleaning target member, wherein a blade surface such as the blade surface 62*b* of the elastic blade, which has a leading end edge portion of the elastic blade on one side thereof and faces the surface of the cleaning target member has a Martens hardness of 1.20 $N/mm^2$ or greater when it is indented by 5 μm at a location that is 20 μm away from the leading end edge portion, a Martens hardness of 1.00 $N/mm^2$ or less when it is indented by 20 μm at the location, and an elastic power of 70% or greater when it is indented by 5 μm at the location.

According to this, as explained for the embodiment described above, it is possible to maintain favorable cleaning by not allowing degradation of the followability of the elastic blade to the image bearing member and by suppressing riding up of the leading end edge portion or wear.

TABLE 1-2

| | Martens hardness [$N/mm^2$] when indented by 5 [μm] | Martens hardness [$N/mm^2$] when indented by 20 [μm] | Elastic power [%] when indented by 5 [μm] | Elastic power [%] when indented by 20 [μm] | Occurrence of cleaning failure | Amount of riding up [μm] | Amount of wear [μm] |
|---|---|---|---|---|---|---|---|
| Ex. 1 | 1.2 | 0.9 | 88 | 91 | Absence | 0 | 0.5 |
| Ex. 2 | 1.2 | 0.9 | 85 | 89 | Absence | 0 | 1 |
| Ex. 3 | 1.62 | 0.92 | 79 | 87 | Absence | 0 | 5 |
| Ex. 4 | 1.7 | 0.92 | 78 | 86 | Absence | 0 | 7.5 |
| Ex. 5 | 1.27 | 0.9 | 85 | 89 | Absence | 0 | 2 |
| Ex. 6 | 1.31 | 0.91 | 83 | 88 | Absence | 0 | 4 |
| Ex. 7 | 1.69 | 0.9 | 74 | 85 | Absence | 0 | 9 |
| Ex. 8 | 1.73 | 0.9 | 70 | 84 | Absence | 0 | 18 |
| Ex. 9 | 1.19 | 0.9 | 84 | 88 | Absence | 0 | 1 |
| Ex. 10 | 1.25 | 0.9 | 84 | 88 | Absence | 0 | 2 |
| Ex. 11 | 1.45 | 0.92 | 84 | 87 | Absence | 0 | 1 |
| Ex. 12 | 1.25 | 0.91 | 81 | 86 | Absence | 0 | 7 |
| Ex. 13 | 1.55 | 0.92 | 78 | 86 | Absence | 0 | 3 |
| Ex. 14 | 1.4 | 0.9 | 83 | 88 | Absence | 0 | 1 |
| Comp. Ex. 1 | 0.8 | 0.89 | 95 | 95 | Presence | 10 | 0.5 |
| Comp. Ex. 2 | 1.05 | 0.89 | 92 | 92 | Presence | 5 | 0.5 |
| Comp. Ex. 3 | 1.85 | 0.93 | 68 | 80 | Presence | 0 | 60 |
| Comp. Ex. 4 | 1.8 | 0.93 | 67 | 80 | Presence | 0 | 45 |
| Comp. Ex. 5 | 1.35 | 1.01 | 85 | 88 | Presence | 0 | 3 |

As can be seen from the results shown in Table 1-2, in Examples 1 to 14, in which Martens hardness when the blade surface was indented by 5 μm was 1.20 $N/mm^2$ or greater, Martens hardness when the blade surface was indented by 20 μm was 1.00 $N/mm^2$ or less, and elastic power when the blade surface was indented by 5 μm was 70% or greater, no riding up of the leading end edge portion was observed, the amount of wear of the blade was small, and favorable cleaning could be maintained. As compared with this, in Comparative Examples 1 to 5, in which the above conditions were not satisfied at the same time, the leading end edge portion rode up or the amount of wear of the blade was large, and it was difficult to maintain favorable cleaning.

Those explained above are examples, and the present invention has specific effects for each of the following aspects.

(Aspect A)

A cleaning blade such as the cleaning blade 62, which is formed of an elastic blade such as the elastic blade 622, and configured to abut on the surface of a cleaning target member such as the photoconductor 3 that allows a leading end edge portion such as the leading end edge portion 62*c* of the elastic (Aspect B)

The cleaning blade according to (Aspect A), wherein the blade surface of the elastic blade has an elastic power of 90% or less when it is indented by 20 μm at the location that is 20 μm away from the leading end edge portion.

According to this, as explained for the embodiment described above, the followability of the elastic blade to the image bearing member will not degrade.

(Aspect C)

The cleaning blade according to (Aspect A) or (Aspect B), wherein a surface layer harder than the elastic blade is provided on the blade surface of the elastic blade.

According to this, as explained for the embodiment described above, riding up of the leading end edge portion can be suppressed by the surface layer.

(Aspect D)

The cleaning blade according to (Aspect C), wherein the surface layer includes at least an ultraviolet curable resin.

According to this, as explained for the embodiment described above, it is only necessary to irradiate the ultraviolet curable resin deposited on the leading end of the elastic blade with ultraviolet. Therefore, it is possible to obtain a surface layer having a desired hardness easily and to manufacture a cleaning blade at low costs.

(Aspect E)

The cleaning blade according to (Aspect C) or (Aspect D), wherein the surface layer has a thickness of 1 μm or less.

According to this, as explained for the embodiment described above, it is possible to suppress wear of the surface layer by suppressing plastic deformation of the surface layer.

(Aspect F)

The cleaning blade according to (Aspect D) and (Aspect E), wherein the ultraviolet curable resin includes at least a fluorine-based acrylic monomer.

According to this, as explained for the embodiment described above, it is possible to suppress riding up of the leading end edge portion by improving the slidability of the surface layer of the cleaning blade.

(Aspect G)

The cleaning blade according to (Aspect F), wherein the fluorine-based acrylic monomer is an acrylate having a perfluoropolyether skeleton and 2 or more functional groups.

According to this, as explained for the embodiment described above, it is possible to suppress riding up of the leading end edge portion by improving the slidability of the surface layer of the cleaning blade. Further, because an acrylate having 2 or more functional groups cross-links with other acrylic monomers and forms a cross-linked film, wear resistance will also be better.

(Aspect H)

The cleaning blade according to (Aspect D), (Aspect E), (Aspect F), or (Aspect G), wherein the ultraviolet curable resin used for the surface layer includes at least: an acrylate having a functional group equivalent molecular weight of 350 or less, 3 to 6 functional groups; pentaerythritol triacrylate as a main skeleton; and an acrylate having a functional group equivalent molecular weight of from 100 to 1,000 and 1 to 2 functional groups; or both thereof.

According to this, as explained for the embodiment described above, it is possible to impart a desired hardness and flexibility to the surface layer.

(Aspect I)

The cleaning blade according to (Aspect A), (Aspect B), (Aspect C), (Aspect D), (Aspect E), (Aspect F), (Aspect G), or (Aspect H), wherein an ultraviolet curable resin including portion such as the ultraviolet curable resin including portion 62*d*, which includes an ultraviolet curable resin, is formed in a portion of the elastic blade that includes the leading end edge portion.

According to this, as explained for the embodiment described above, the hardness of the leading end edge portion is increased, which makes it possible to suppress the leading end edge portion from deforming to the direction in which the image bearing member is moved. Further, also when the elastic blade is exposed by aging wear of the surface layer, such a deformation can be suppressed by the ultraviolet curable resin included in the leading end edge portion.

(Aspect J)

The cleaning blade according to (Aspect F) or (Aspect G), wherein the ultraviolet curable resin including portion is formed by impregnating the elastic blade with the ultraviolet curable resin, from a blade leading end surface of the elastic blade, which is a surface that has the leading end edge portion on one side thereof and is parallel with the thickness direction of the blade.

According to this, as explained for the embodiment described above, it is possible to easily manufacture the ultraviolet curable resin including portion including the ultraviolet curable resin in the elastic blade.

(Aspect K)

The cleaning blade according to (Aspect I) or (Aspect J), wherein the ultraviolet curable resin used for the ultraviolet curable resin including portion includes at least: an acrylate having a functional group equivalent molecular weight of 350 or less, 3 to 6 functional groups, and pentaerythritol triacrylate as a main skeleton; an acrylate having a functional group equivalent molecular weight of from 100 to 1,000, and 1 to 2 functional groups; or both thereof.

According to this, as explained for the embodiment described above, it is possible to impart a desired hardness and flexibility to the ultraviolet curable resin including portion.

(Aspect L)

The cleaning blade according to (Aspect A), (Aspect B), (Aspect C), (Aspect D), (Aspect E), (Aspect F), (Aspect G), (Aspect H), (Aspect I), (Aspect J), or (Aspect K), wherein a rubber formed of a single layer and including a urethane group, or a rubber formed by laminating 2 different kinds of rubbers each including a urethane group is used as the elastic blade.

According to this, as explained for the embodiment described above, because a rubber including a urethane group has a high repulsive elastic modulus and follows up the image bearing member well, it is possible to maintain favorable cleaning performance.

(Aspect M)

An image forming apparatus configured to transfer an image formed on an image bearing member such as the photoconductor 3 as a surface motion member finally onto a recording medium, wherein the cleaning blade according to (Aspect A), (Aspect B), (Aspect C), (Aspect D), (Aspect E), (Aspect F), (Aspect G), (Aspect H), (Aspect I), (Aspect J), (Aspect K), or (Aspect L) is used as a cleaning member configured to contact the surface of the image bearing member to remove any unnecessary deposited matters deposited on the surface.

According to this, as explained for the embodiment described above, it is possible to maintain favorable cleaning by not allowing degradation of the followability of the elastic blade to the image gearing member and by suppressing riding up of the leading end edge portion or wear.

(Aspect N)

A process cartridge, which is configured to integrally support an image bearing member and a cleaning unit including at least a cleaning blade for removing residual toner deposited on the surface of the image bearing member, and which is detachably mountable on an image forming apparatus body, wherein the cleaning blade according to (Aspect A), (Aspect B), (Aspect C), (Aspect D), (Aspect E), (Aspect F), (Aspect G), (Aspect H), (Aspect I), (Aspect J), (Aspect K), or (Aspect L) is used as the cleaning blade.

According to this, as explained in the embodiment described above, it is possible to provide a process cartridge having a favorable cleaning performance, by integrally configuring the cleaning blade as the process cartridge.

This application claims priority to Japanese application No. 2013-011264, filed on Jan. 24, 2013 and incorporated herein by reference.

What is claimed is:

1. A cleaning blade, comprising an elastic blade, wherein the cleaning blade is configured to abut on a surface of a cleaning target member, which allows a leading end edge portion of the elastic blade to move on the surface thereof, to remove powder from the surface of the cleaning target member, and wherein a blade surface of the elastic blade, which comprises the leading end edge portion of the elastic blade on one side thereof and faces the surface of the cleaning target member, has a Martens hardness of 1.20 N/mm$^2$ or greater when it is indented by 5 μm at a location that is 20 μm away from the leading end edge portion, a Martens hardness of 1.00 N/mm$^2$ or less when it is indented by 20 μm at the location, and an elastic power of 70% or greater when it is indented by 5 μm at the location.

2. The cleaning blade according to claim 1, wherein the blade surface of the elastic blade has an elastic power of 90% or less when it is indented by 20 μm at the location that is 20 μm away from the leading end edge portion.

3. The cleaning blade according to claim 1, wherein a surface layer harder than the elastic blade is provided on the blade surface of the elastic blade.

4. The cleaning blade according to claim 3, wherein the surface layer comprises an ultraviolet curable resin.

5. The cleaning blade according to claim 4, wherein the ultraviolet curable resin used for the surface layer comprises a fluorine-based acrylic monomer.

6. The cleaning blade according to claim 5, wherein the fluorine-based acrylic monomer is an acrylate having a perfluoropolyether skeleton and 2 or more functional groups.

7. The cleaning blade according to claim 4, wherein the ultraviolet curable resin used for the surface layer comprises at least one selected from the group consisting of: an acrylate having a functional group equivalent molecular weight of 350 or less, 3 to 6 functional groups, and pentaerythritol triacrylate as a main skeleton; and an acrylate having a functional group equivalent molecular weight of from 100 to 1,000 and 1 to 2 functional groups.

8. The cleaning blade according to claim 3, wherein the surface layer has a thickness of 1 μm or less.

9. The cleaning blade according to claim 1, wherein a ultraviolet curable resin comprising portion, which comprises an ultraviolet curable resin, is formed in a portion of the elastic blade that comprises the leading end edge portion.

10. The cleaning blade according to claim 9, wherein the ultraviolet curable resin comprising portion is formed by impregnating the elastic blade with the ultraviolet curable resin, from a blade one end surface of the elastic blade, which is a surface that comprises the leading end edge portion of the elastic blade on one side thereof and is parallel with a direction of a thickness of the elastic blade.

11. The cleaning blade according to claim 9, wherein the ultraviolet curable resin used for the ultraviolet curable resin comprising portion comprises at least one selected from the group consisting of: an acrylate having a functional group equivalent molecular weight of 350 or less, 3 to 6 functional groups, and pentaerythritol triacrylate as a main skeleton; and an acrylate having a functional group equivalent molecular weight of from 100 to 1,000 and 1 to 2 functional groups.

12. The cleaning blade according to claim 1, wherein a rubber that is formed from a single layer and comprises a urethane group, or a rubber that is formed by laminating 2 different kinds of rubbers that each comprise a urethane group, is used as the elastic blade.

13. An image forming apparatus, comprising:

an image bearing member as a surface motion member;

a transfer unit configured to transfer an image formed on the image bearing member onto a recording medium; and a cleaning unit that comprises a cleaning blade configured to contact a surface of the image bearing member to remove unnecessary deposited matters deposited on the surface, wherein the cleaning blade comprises an elastic blade, wherein the cleaning blade is configured to abut on a surface of a cleaning target member, which allows a leading end edge portion of the elastic blade to move on the surface thereof, to remove powder from the surface of the cleaning target member, and wherein a blade surface of the elastic blade, which comprises the leading end edge portion of the elastic blade on one side thereof and faces is the surface of the cleaning target member, has a Martens hardness of 1.20 N/mm$^2$ or greater when it is indented by 5 μm at a location that is 20 μm away from the leading end edge portion, a Martens hardness of 1.00 N/mm$^2$ or less when it is indented by 20 μm at the location, and an elastic power of 70% or greater when it is indented by 5 μm at the location.

14. A process cartridge, comprising:

an image bearing member; and a cleaning unit that comprises a cleaning blade configured to remove residual toner deposited on a surface of the image bearing member, wherein the process cartridge is detachably mountable on an image forming apparatus body, wherein the cleaning blade comprises an elastic blade, wherein the leaning blade is configured to abut on a surface of a cleaning target member, which allows a leading end edge portion of the elastic blade to move on the surface thereof, to remove powder from the surface of the cleaning target member, and wherein a blade surface of the elastic blade, which comprises the leading end edge portion of the elastic blade on one side thereof and faces the surface of the cleaning target member, has a Martens hardness of 1.20 N/mm$^2$ or greater when it is indented by 5 μm at a location that is 20 μm away from the leading end edge portion, a Martens hardness of 1.00 N/mm$^2$ or less when it is indented by 20 μm at the location, and an elastic power of 70% or greater when it is indented by 5 μm at the location.

* * * * *